United States Patent [19]

Voorhees et al.

[11] 4,078,416

[45] Mar. 14, 1978

[54] METHOD AND APPARATUS FOR FEEDING STRIP STOCK INTO A MACHINE

[75] Inventors: John E. Voorhees, Sidney; Ronald F. Fortman, Fort Loramie; Daniel A. Schoch, Minster; Robert M. Carabbio, St. Mary's, all of Ohio

[73] Assignee: The Minster Machine Company, Minster, Ohio

[21] Appl. No.: 730,319

[22] Filed: Oct. 7, 1976

[51] Int. Cl.[2] ..... B21D 43/00

[52] U.S. Cl. ..... 72/419; 226/178; 226/181

[58] Field of Search ..... 72/419, 420, 421, 425, 72/7, 24, 28, 31, 32, 33; 226/8, 9, 35, 120, 152, 154, 167, 168, 178, 181, 187, 100; 271/256; 83/261, 71, 222; 74/113

[56] References Cited

U.S. PATENT DOCUMENTS

| | | | |
|---|---|---|---|
| 2,722,276 | 11/1955 | Revelle | 83/211 |
| 3,229,556 | 1/1966 | Jensen | 83/211 |
| 3,590,624 | 7/1971 | Pax | 72/425 |
| 3,606,117 | 9/1971 | Fagan et al. | 226/8 |
| 3,699,832 | 10/1972 | Smith et al. | 83/261 |
| 3,707,255 | 12/1972 | Ridgway et al. | 226/154 |
| 3,782,618 | 1/1974 | Voorhees | 226/177 |
| 3,907,188 | 9/1975 | Peterson | 226/154 |
| 3,914,977 | 10/1975 | Rimmer | 72/421 |
| 3,957,188 | 5/1976 | Papsdorf | 226/9 |

*Primary Examiner*—Michael J. Keenan

*Attorney, Agent, or Firm*—Albert L. Jeffers; John F. Hoffman

[57] ABSTRACT

A method and apparatus for feeding strip stock into a machine, such as a press, in which opposed feed rolls are closed on the strip stock for frictionally engaging the strip stock and one thereof is accelerated from a stopped position and is then decelerated back to a stopped position for a feed cycle with a control system provided for determining the precise point during a feed cycle to initiate deceleration of the feed roll. At the end of a feed cycle, the feed rolls are again separated.

20 Claims, 8 Drawing Figures

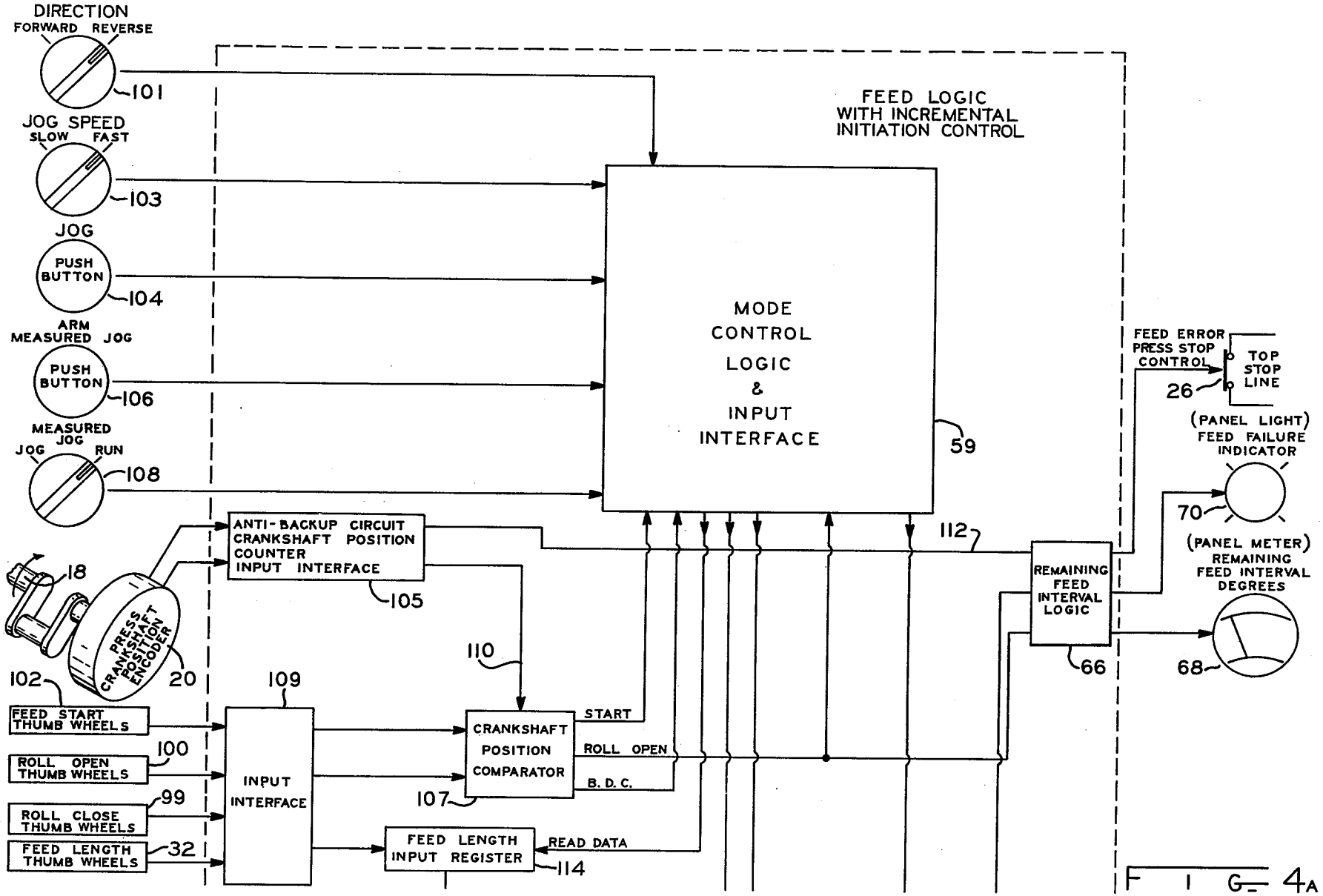
FIG. 4A
FEED LOGIC WITH INCREMENTAL INITIATION CONTROL
MODE CONTROL LOGIC & INPUT INTERFACE
59
112
REMAINING FEED INTERVAL LOGIC
66
FEED ERROR PRESS STOP CONTROL
26
TOP STOP LINE
(PANEL LIGHT) FEED FAILURE INDICATOR
70
(PANEL METER) REMAINING FEED INTERVAL DEGREES
68
ANTI-BACKUP CIRCUIT CRANKSHAFT POSITION COUNTER INPUT INTERFACE
105
110
CRANKSHAFT POSITION COMPARATOR
107
START
ROLL OPEN
B. D. C.
READ DATA
FEED LENGTH INPUT REGISTER
114
INPUT INTERFACE
109
CRANKSHAFT POSITION ENCODER
20
18
FEED START THUMB WHEELS
102
ROLL OPEN THUMB WHEELS
100
ROLL CLOSE THUMB WHEELS
99
FEED LENGTH THUMB WHEELS
32
DIRECTION
FORWARD
REVERSE
101
JOG SPEED
SLOW
FAST
103
JOG
PUSH BUTTON
104
ARM MEASURED JOG
PUSH BUTTON
106
MEASURED JOG
JOG
RUN
108

METHOD AND APPARATUS FOR FEEDING STRIP STOCK INTO A MACHINE

BACKGROUND OF THE INVENTION

Field of the Invention

The present invention relates to a method and apparatus for feeding strip stock into a machine, such as a metal stamping press or the like, and is especially concerned with a roll type stock feeder.

The feeding of strip stock into machines, such as metal stamping presses, is well known and is often carried out by actuating the feed mechanism by the moving parts of the machine, such as a press.

In a press, for example, there is a reciprocating press slide which carries out the work to be done on the stock in the press, and during movement of the press slide, according to the prior art practices, mechanical feeding mechanisms are actuated as through a series of links, shafts, or belts and pulleys from the press crankshaft which drives the slide to feed stock into the press while synchronizing the feeding of the stock with the reciprocating motion of the press slide.

The amount of feed on each cycle can be changed in an arrangement of this nature, for example, by changing the diameter of a feed roll which frictionally engages the strip stock and effects the feeding of the stock into the press. The mechanical linkage, if employed, can also be adjusted to change the amount of rotation of the feed rolls, or changes can be made in a geared drive to the rolls if such a geared drive is provided. Frequently such mechanical feed systems employ a rotating cam mechanically driven by the press crankshaft which operates a lever to mechanically lift the pinch roll (the non-driven roll) off the stock. If any timing adjustment is to be made on such a mechanism, it becomes a mechanical adjustment that is approached with wrenches and possibly even changes of cams in order to alter the timing of opening and closing of the pinch roll. Some roll lift controls for use in extremely low speed electric feeds have also been employed where the speed of feeding is in the neighborhood of 40 cycles per minute and under as compared to speeds of up to 1500 strokes per minute when employing the principles of the present invention. Many of these prior art electrical feeds are built independent of the press standing on the floor in their own cabinet and not physically connected to the press. They use compressed air in cylinders or air bags to produce the force to open the rolls. Some such systems employ a solenoid valve to control the air to the pneumatic actuators that lift the pinch roll. The solenoid valve is in turn controlled by electrical contacts on the press limit switch that is driven in synchronism with the press crank shaft. In these systems it is possible to mechanically adjust the angular position of these contacts to produce opening and closing of the pinch roll at the desired position in the press cycle, but again, this is a mechanical adjustment carried out on the limit switch on the press itself in order to adjust timing of the feed. All of the expedients referred to above require time and/or extra parts to be provided for adjustment of the feed system and, in general, are troublesome, expensive, and time consuming.

In roll type feeders, the rolls are generally moved toward each other to engage the stock during a feed cycle and are separated from each other at the end of a feed cycle in order to leave the stock free during the working operation.

The operation of opening and closing the feed rolls in a roll type stock feeder is also important because of the time consumed in moving the rolls and for the reason that the closing force exerted on the rolls must produce sufficient frictional engagement of the rolls with the stock to effect feeding thereof when the rolls rotate but without damaging the stock when the rolls move together.

With the foregoing in mind, a primary objective of the present invention is the provision of a stock feeding arrangement, especially a roll type stock feeding arrangement, and a method of operation thereof, which produces superior results in connection with stock feeding.

Another object is the provision of a method and apparatus as referred to above in which the timing of the feed cycle may be easily adjusted, thereby leaving the maximum portion of the press cycle for feeding the stock as permitted by the particular requirements of the die being operated in the press, and thus, permitting maximum speed of operation of the machine with which the stock feeding apparatus is associated.

SUMMARY OF THE INVENTION

According to the present invention, a stock feeding arrangement is provided in which a pair of rollers are arranged in opposed relation and a strip of stock is introduced between the rollers and will be advanced into the machine thereby when the rolls, or rollers, are brought into pressure engagement with opposite sides of the strip and at least one thereof is driven in rotation.

According to the present invention, a source of controllable torque is connected to the driven roller and a lifting mechanism is associated with the other roller for moving the rollers toward and away from each other.

The controllable source of torque, which may be an electric motor or a hydraulic motor, is monitored as to speed of rotation and amount of rotation during a feed cycle, and at a point in the feed cycle the source of torque reverses the supply of torque to the driven feed roll causing it to decelerate and come to a halt. The instant that the torque output of the torque source is reversed is determined in conformity with the feed signal and the monitored rotational velocity and the rotational travel of the torque source from the instant of initiation of a feed cycle.

By selecting the exact instant for reversal of torque from the torque source that will exactly absorb the inertial energy in the feed system at the time the desired feed motion is completed, the minimum amount of time is expended for the feeding operation, leaving the maximum amount of time available for machine operation.

The exact nature of the present invention will become more clearly apparent upon reference to the following detailed specification taken in connection with the accompanying drawings in which.

Figure 4B:
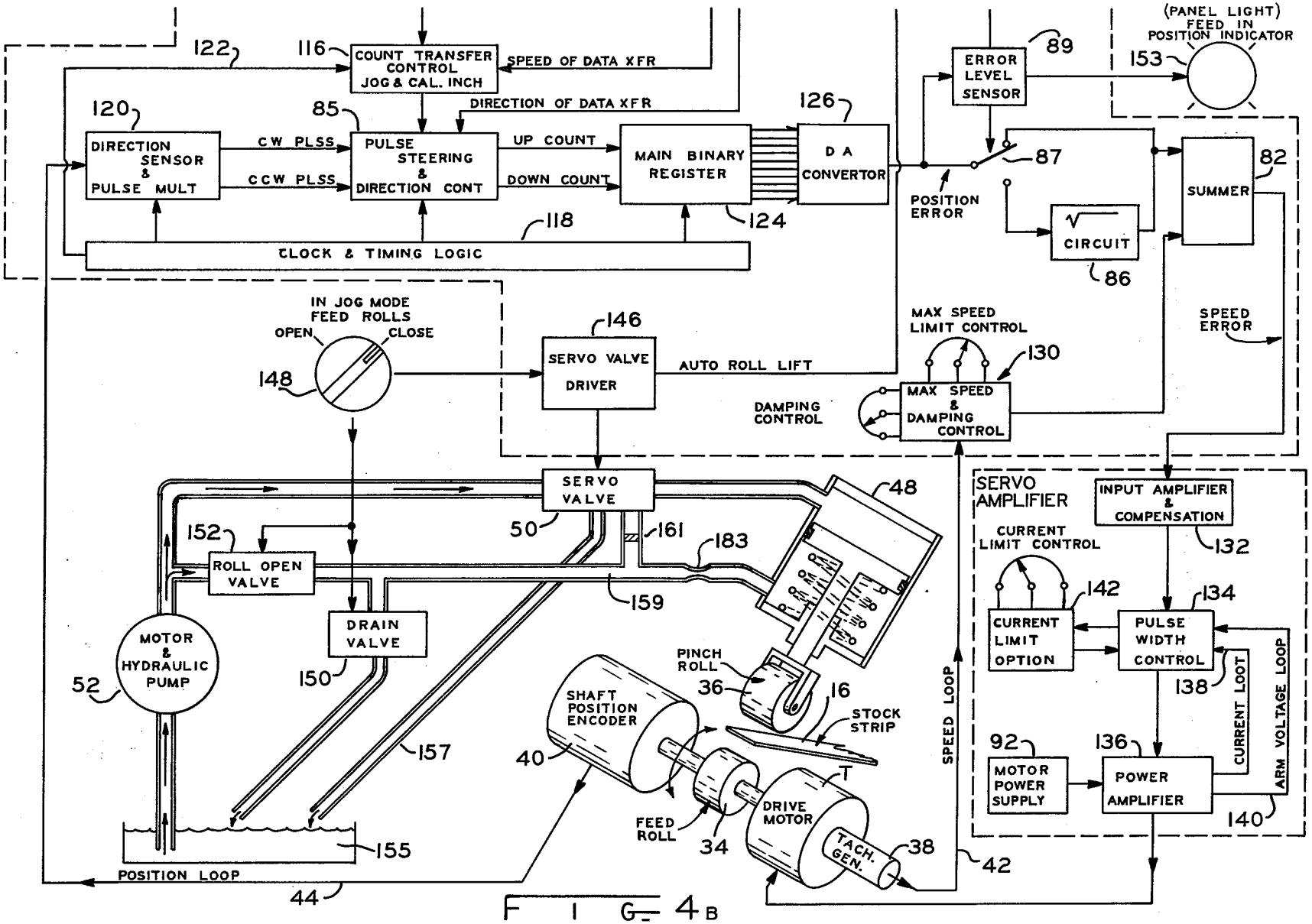

FIG. 4 formed by joining FIGS. 4A and 4B is a more detailed showing of a control circuit for a stock feeding device according to the present invention.

Figure 5:
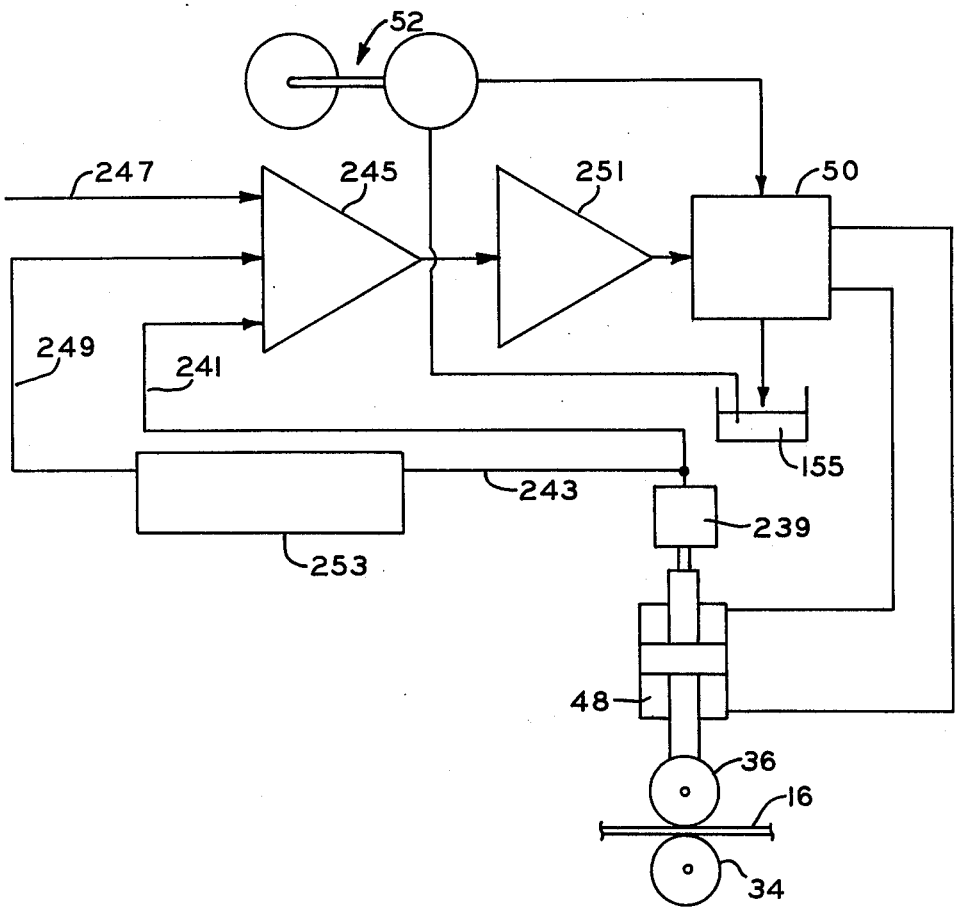

FIG. 5 is a schematic representation of an alternate roll lift system.

Figure 6:
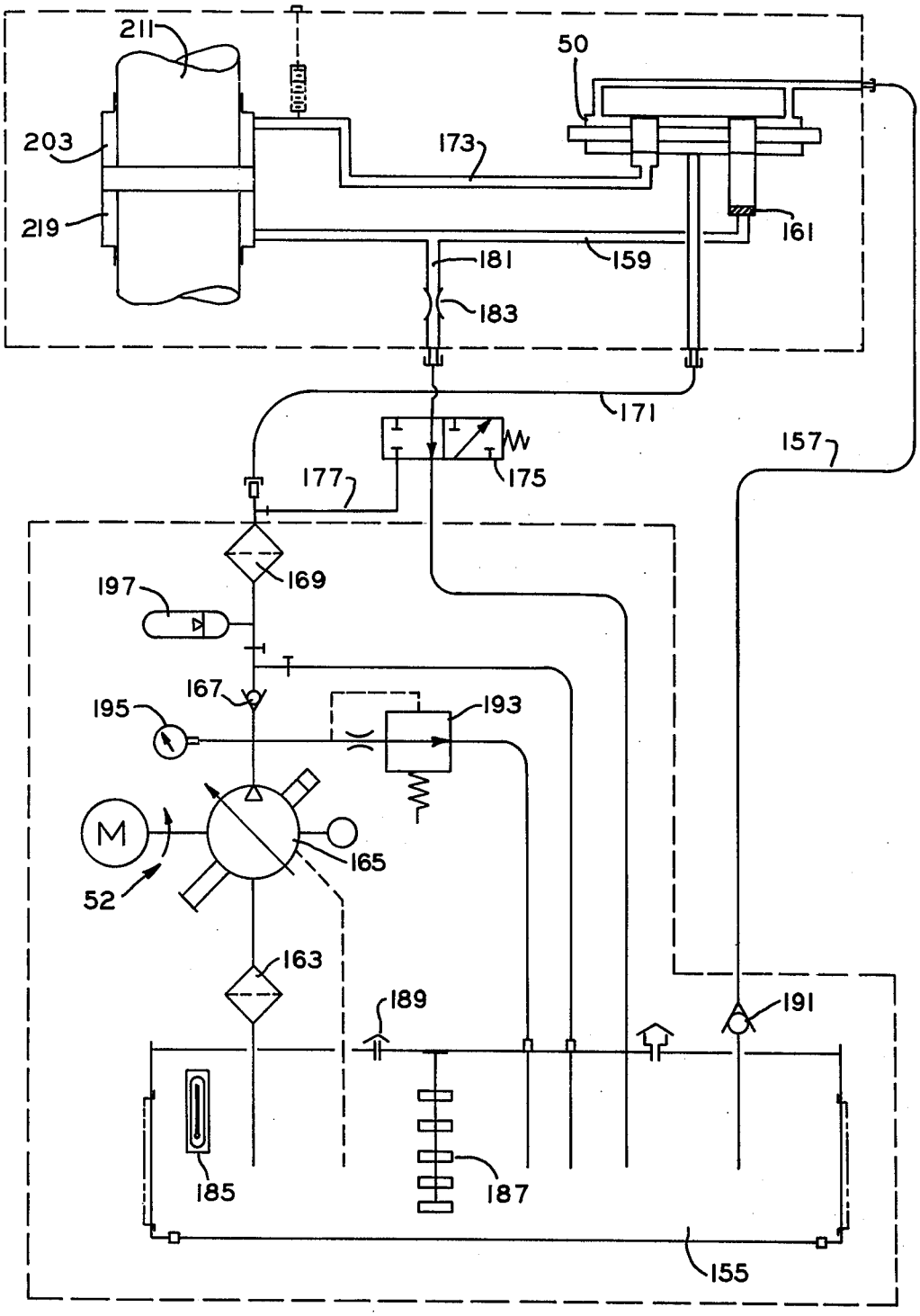

FIG. 6 schematically illustrates in greater detail the hydraulic roll lifting arrangement which may be employed in the system of FIG. 4.

Figure 7:
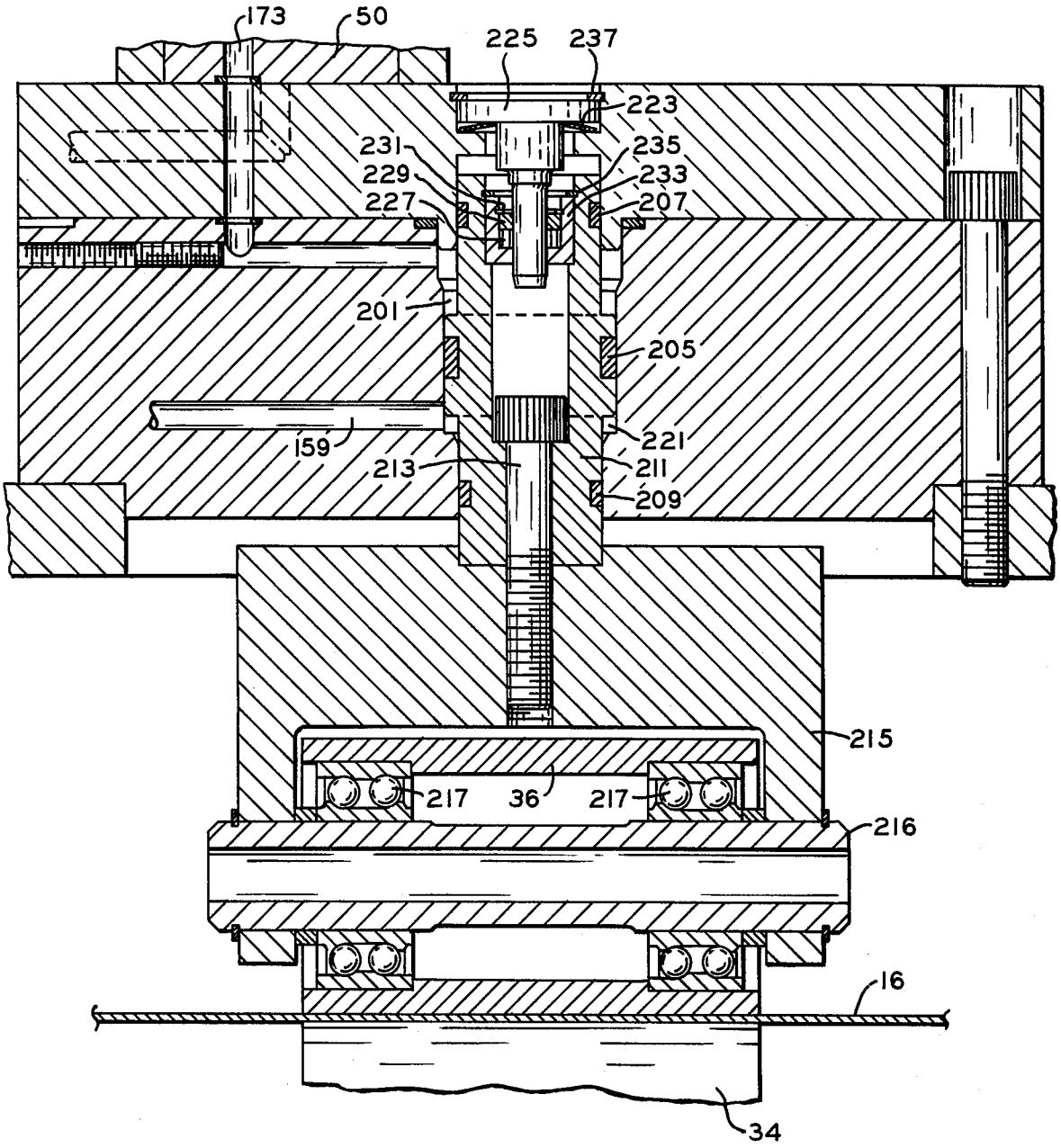

FIG. 7 is a cross-section view of the preferred roll lift mechanism.

DESCRIPTION OF THE PREFERRED EMBODIMENT

Figure 1:
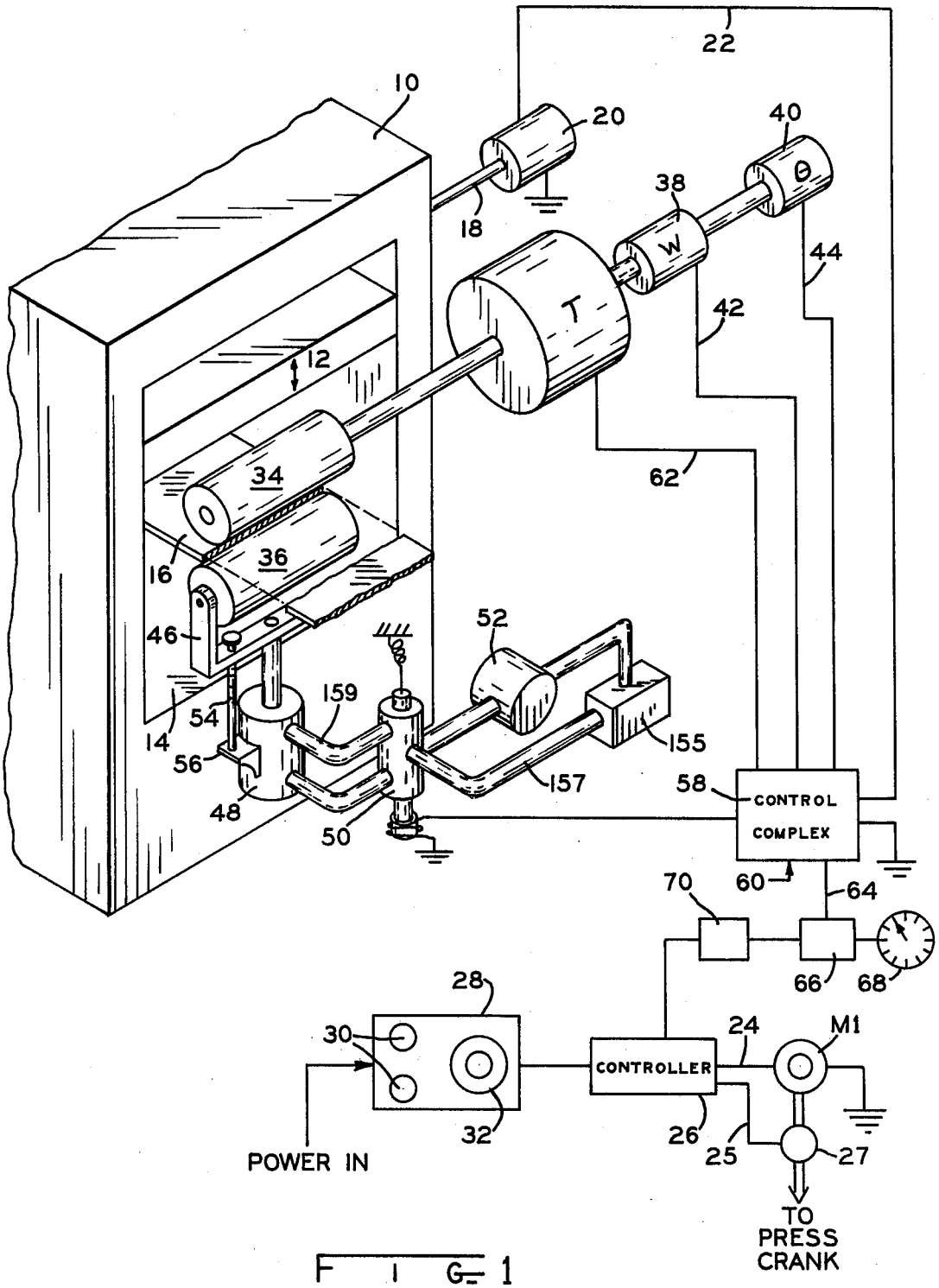
FIG. 1 is a schematic view showing a feed installation according to the present invention.

Referring to the drawings somewhat more in detail, in FIG. 1, 10 represents a machine frame such as the frame of a mechanical metal stamping press. The press has mounted therein a slide 12 which reciprocates in the direction of the arrow thereon within the press frame and, by means of the elements of the die set mounted on the underneath side of slide 12 and on the upper side of bed 14 of the press, perform work operations, such as blanking, forming and cutting and the like on a strip of stock 16 being fed into the press from a supply thereof which is not shown in FIG. 1.

The slide 12 is driven in reciprocatory motion by a crankshaft mounted in the crown of the press, said crankshaft having an extension 18 which drives a component 20 which provides an encoded signal to line 22 representative of the angular or rotated position of the crankshaft during each rotation of the crankshaft.

The crankshaft may be driven by a motor M1 which is supplied with electric power via a line 24 which extends from motor M1 through a controller 26 to an adjustable controller 28 which may include start and stop switches, indicated at 30, and an adjustable speed control member at 32. The control of motor M1 is conventional, except for the provision of controller 26, which provides for interrupting of the power to the motor M1 under certain conditions. Alternately, and generally preferably, controller 26 does not disable motor M1, but rather, exercises an override function by way of line 25 on clutch 27, which clutch selectively couples motor M1 to the press crankshaft in a conventional manner, to prevent the clutch from engaging to operate the press under these certain conditions.

At the side of the press are feed rolls 34 above strip 16 and 36 below strip 16. Feed roll 34 is mounted on a shaft which is driven by a torque source T which, in turn, drives a speed encoder 38 and a position encoder 40. Speed encoder 38 provides a signal $w$ to a line 42 which is indicative of the speed of rotation of the torque source T and, therefore, of roll 34, while position encoder 40 supplies a signal $\theta$ to line 44 which is representative of the angular position of torque source T and, therefore, roll 34 from a reference position such as the rest position at the beginning of a press cycle. Assuming that rolls 34 and 36 engage stock 16 in a slip-free manner, it will be apparent that components 38 and 40 provide signals representative of the speed and amount of movement of stock 16 during a feed cycle.

Lower roller 36 is mounted in a yoke 46 which is mounted on the ram of a fluid actuator 48 supplied via servo valve 50 from a source of pressure 52. The yoke 46 may have an adjustable abutment element 54 engageable with a stop 56 when the yoke is in its lowermost position to limit the operating movement of roll 36. This stop function can also be built into the fluid actuator if so desired.

The system includes a control complex 58 supplied with energy via an input line 60 and also connected to lines 22, 42 and 44. A further line 62 is provided leading to torque source T and supplying power to the torque source during driving of roll 34 while absorbing power from the torque source during deceleration of roll 34.

Alternatively, line 62 could supply power to the torque source and, then, when deceleration of the feed roll 34 is to be initiated, the power supplied by line 62 could be interrupted and the torque source braked or otherwise caused to absorb power to dissipate the inertial energy in the stock feeding system.

Control complex 58 is also connected by a line 64 to a component 66 which supplies a coded signal to an indicating instrument 68 and also to a component 70 which is connected in controlling relation to component 26 which, as has been explained, could comprise a power interrupting circuit breaker or preferably, could function to hold the clutch in its disengaged state under certain conditions. The indicating instrument at 68 indicates the amount of rotation of the crankshaft of the press which is still available for the feeding operation at the instant that the feeding operation is terminated.

Figure 2:
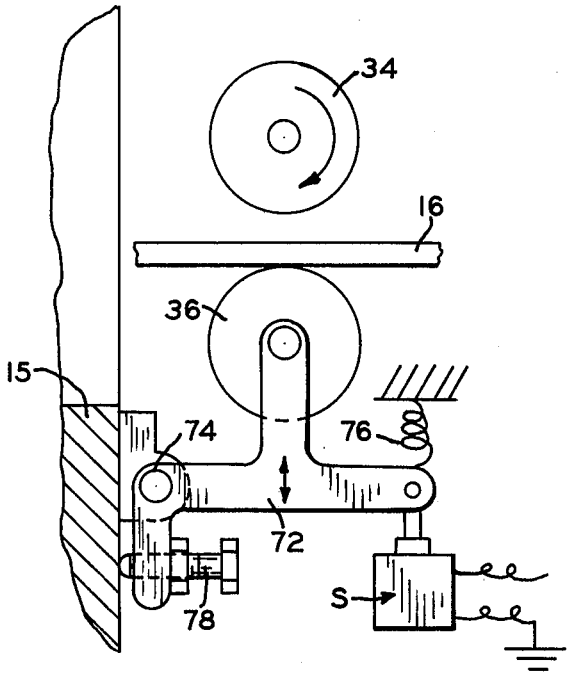
FIG. 2 is a fragmentary view showing a modification.

In the feed installation of FIG. 1, the lower roll 36 is actuated to engage strip stock 16 by a fluid actuator, while in FIG. 2, lower roll 36 is mounted on a lever 72 pivoted to the frame 15 of the feed by bracket 74 at one end having a spring 76 which urges the lever in a direction to close roll 36 on roll 34.

The lever 72 has also connected thereto a solenoid arrangement, generally indicated at S, which receives a signal from control complex 58 when the feed rolls are to be opened. Lever 72 has an adjustable abutment element 78 thereon which can be adjusted to limit the degree of opening of the rolls and thereby regulate the amount of time which is lost in closing the rolls at the beginning of a feed cycle.

Figure 3:
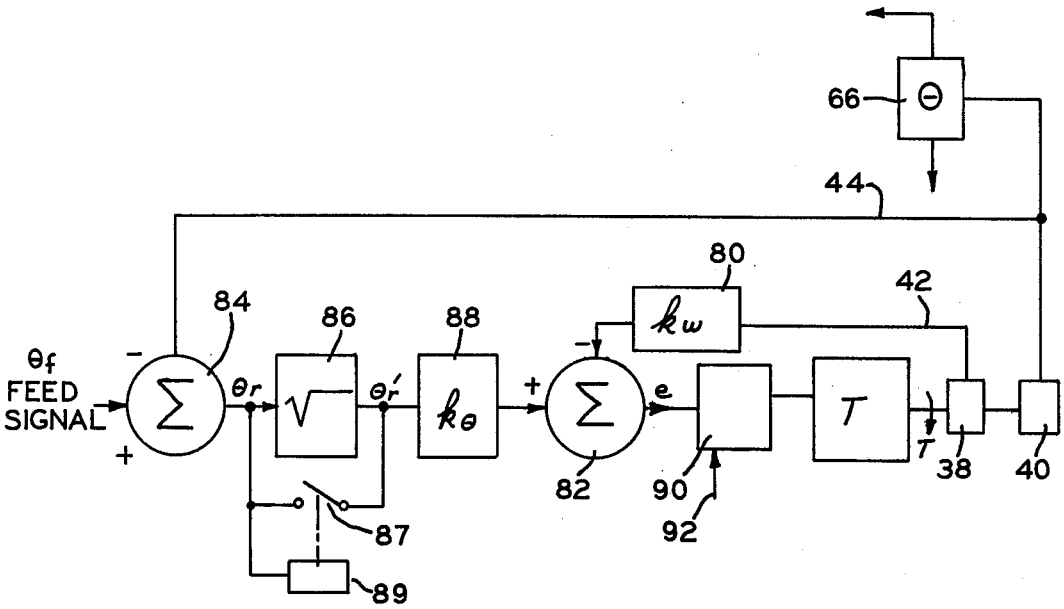
FIG. 3 is a schematic representation of the control circuit for controlling the torque output of the torque source.

FIG. 3 schematically illustrates the control complex 58 wherein it will be seen that speed encoding component 38 is connected by line 42 to a multiplier 80 wherein the value $w$, representative of the angular velocity of torque source T, is multiplied by a factor $k_w$ resulting in an output $k_w w$ which is supplied as a negative input to a summer 82.

The position encoder 40, which supplies a signal $\theta$ representative of the amount of rotation of torque source T from a rest or other reference position during a feed cycle supplies its signal via line 44 as a negative input to a second summer 84 which has as a positive input a signal $\theta_f$ which is the input signal corresponding to the amount of feed desired on the respective press cycle.

The output of summer 84 is a signal $\theta_r = \theta_f - \theta$ which is fed to a component 86 within which a function of the square root is taken, and leading to an output signal of $\theta'_r$ which is supplied to a gain element 88 within which the signal $\theta'_r$ is multiplied by a factor $k_\theta$. The term $\theta'_r$ is defined as follows:

$$\theta'_r = \sqrt{\theta_f - \theta} \text{ when } \theta_f - \theta \geqq 0$$

$$\theta'_r = \sqrt{\theta - \theta_f} \text{ when } \theta_f - \theta < 0$$

The output of component 88 is $k_\theta \theta'_r$ and is supplied to summer 82. The output from summer 82 is in the form of a signal $e = k_\theta \theta'_r - k_w w$ which is supplied to a power controller 90 which controls the supply of power from a supply line 92 to torque source T and also controls the absorption of power from source T during deceleration thereof, or controls the braking of source T.

The torque source usually has the characteristic of a limited maximum value of torque available due to practical considerations such as power dissipation within the device, power available, component size, cost, or any of many other reasons. Also the system will have a given amount of rotational inertia J, composed of the inertias of the torque source, feed roll, idler roll, the position and velocity monitoring devices, and the equivalent rotational inertia of the stock.

The basic action of the control system is to accelerate the stock as rapidly as possible until a given point in the movement is reached, and then decelerate the stock so that it comes to rest at exactly the feed length desired. The decision regarding when to apply the deceleration torque is crucial. If it is applied too late, the torque source will not be able to brake hard enough and the stock will overshoot its intended final position. If applied too early, the time required to feed will be longer than necessary.

By looking at the energy balance of the system, one can calculate the optimum deceleration point. The energy ($E_s$) of the system is:

$$E_s = \tfrac{1}{2} Jw^2$$

where

J is the system inertia at the torque source shaft; and $w$ is the rotational velocity of the torque source shaft.

The amount of energy $E_b$ that the torque source can remove from the system within its remaining rotation movement $\theta_r$ in radians is given by:

$$E_b = T_{mr}\theta_r$$

where $T_{mr}$ is the maximum available decelerating torque.

Deceleration should start at or slightly before, but not later than the point where $E_b = E_s$; that is, the deceleration ability should be just able to remove the system energy in the remaining rotational movement of the torque source shaft.

Or in mathematical terms, the following equation is to be satisfied:

$$T_{mr}\theta_r - \tfrac{1}{2} Jw^2 = 0$$

Heretofore, typical positioning servo-mechanisms have established conditions such that deceleration of the feed mechanism occurs when $\theta_r K_\theta = K_w w$, where $K_\theta$ and $K_w$ are constants.

This equation for a typical state-of-the-art control system is not, however, of the form that was derived previously, but is, rather, a simple linear relationship between $\theta_r$ and $w$. In contrast, what was derived previously was an energy relationship.

The block diagram shown in FIG. 3 overcomes the deficiency of conventional control systems and produces the proper energy relationship. Assuming $\theta_r$ is positive, the condition for the beginning of deceleration is given as:

$$K_\theta\sqrt{\theta_r} = K_w w, \text{ that is } e = 0.$$

Squaring both sides:

$$K_\theta^2\theta_r = K_w^2 w^2$$

$$K_\theta^2\theta_r - K_w^2 w^2 = 0$$

Comparing this with what was previously derived, $$T_{mr}\theta_r - \tfrac{1}{2} Jw^2 = 0$$

from the last two equations, it will be seen that the relationship that must hold between the coefficients of the two equations is:

$$\frac{K_\theta^2}{K_w^2} = \frac{T_{mr}}{\frac{J}{2}}$$

or $$\frac{K_\theta}{K_w} = \sqrt{\frac{2T_{mr}}{J}}$$

This last equation gives the relative values of $K_\theta$ and $K_w$ and the system, as shown, and using the derived values, is operable in the intended manner.

A system such as shown in FIG. 3 was implemented using a direct current servo-motor and servo-amplifier as the controlled torque source, and monitoring the position and velocity of the driven feed roll by means of an encoder and a tachometer generator on the servo-motor shaft.

Referring to FIG. 4 and again to the feed rolls, the system has been designed in such a way that a selector 100 mounted on the control panel permits the selection of the particular press crank angle position at which roll lifting, or opening, should, or must, be accomplished. In one unit tested, it was arranged to provide for closing the feed rolls at the bottom dead center crank angle position of the press in all cases, although this function could also have been program controlled via control logic 59 as well as the roll opening action.

In considering roll opening timing, it is highly desirable to assure that the feed motion of the stock 16 has been completed before the feed rolls 34, 36 are separated by the roll lift system. A controlled system 50, 48 such as that disclosed herein is not mechanically driven by the press on which it is used; therefore, the time of feed roll opening need not correspond to a fixed crank angle, as would often be the case in a mechanically actuated system.

For any particular weight of material and feed length being produced, a certain feeding time will be required. This means that at very low speeds of the press only a few degrees of crankshaft rotation will occur during the action of the feed unit. As press speed is increased, however, the speed of feeding does not change, and the feeding action will require an increasing interval of crankshaft rotation for its accomplishment. For a particular stroke of press slide 12 and a particular die installed in the press, there will be only a limited portion of the press operating cycle during which feeding may proceed without interference between stock and die. At the end of this feeding cycle, the feed rolls must be separated to permit piloting of the stock within the die.

The feed unit disclosed herein is designed so that the instant of feed motion completion is signaled to the control system which is also continuously monitoring crankshaft rotation of the press. The control system then indicates on panel meter 68 the number of degrees of crankshaft rotation remaining between the point of completion of feeding and the programmed crank angle at which roll lifting is to occur. This angular measure is indicated on the panel meter 68 as "Remaining Feed Interval, Degrees," and indicates whether or not it is safe to increase the operating speed of the press.

When the remaining feed interval declines to zero, a further increase in press speed would result in the roll lift action occuring prior to completion of feeding, with the result of inaccurate feeding. The feed system disclosed herein is arranged in such a way that a fault signal is developed whenever the remaining feed interval falls below zero degrees. The fault signal, via controller 26, automatically stops the press to prevent the production of faulty parts or damage to the die.

Another feature of the control system is the arrangement for programming the press crank angle position at which feeding is to be initiated. This arrangement, provided for by selector 102 of the control unit, permits the particular press stroke and die characteristics to be taken into account so that feeding action may be initiated at the earliest safe time when the punches and pilots in the die no longer engage the stock. This is in contrast to the normal mechanical feed unit in which the total feeding interval is fixed to a particular interval of press crankshaft rotation.

The closing action of rolls 34, 36 of the feed mechanism will occupy a fixed time interval regardless of the speed of press operation. This is because the roll closing action is controlled by a hydraulic system that is not mechanically coupled to rotation of the press crankshaft. It is conceivable that at high press speeds the roll closing action will occupy a number of degrees of crankshaft rotation. With roll closing set by thumbwheel 99 to be initiated at a particular crank angle position, the situation could arise that the feed rolls have not fully closed by the time the crank angle is reached at which feeding is programmed to begin.

The control system of the present invention has been arranged so that a given time interval must elapse after the roll closing signal is issued before feeding can be initiated. This time is made slightly greater than the time determined to be required for the roll closing action of the feed. Regardless of when the start of feeding is programmed to occur by selector 102 in terms of crank angle degrees, the control system is arranged to prevent start of feeding before the time has elapsed to assure that the rolls have fully closed. This will avoid the possibility of inaccurate feeding that would occur if the feed rolls should begin to rotate before they tightly grip the stock.

In respect of FIG. 3 and component 86 therein which performs a square root function, this component can be bypassed by a normally open switch 87 under the control of an actuator 89 which is sensitive to the signal at the outlet of summer 84. The strength of the signal from summer 84 is representative of the remaining amount of travel required by the feed roll which thus diminishes as the feed roll approaches final position. The circuit is arranged so that as the feed roll approaches final position, switch 87 will close thus providing for a supply of a linear function to multiplier 88 rather than a square root function, and thus limiting the "stiffness" of the deceleration of the driven roll.

In comparing FIGS. 3 and 4 it will be noted that multipliers 80 and 88 are not shown in FIG. 4. As noted earlier it is the ratio of these constants which is of concern and therefore $K_\theta$ may be made a constant value and $K_w$ may be built in to the output of the speed encoder (a tachometer generator) as desired or the speed and damping control 130 may be employed to introduce the appropriate factor.

FIG. 4 shows more in detail the control circuitry which is illustrated in FIG. 3 and carries the same reference numerals where applicable. FIG. 4, however, shows a direction control switch 101, a jog speed selector switch 103, a jog push button 104, a measured jog push button 106 and a jog and run selector switch 108, all connected to supply commands to the control logic 59.

The circuit of FIG. 4 also shows that adjustable feed control member 32 and selectors 100 and 102 are adjustable thumb wheels, the latter two of which supply commands through an interface 109 and a position comparator 107 to control logic 59, and also to previously described indicating component 68 by way of logic component 66.

The encoder 20 driven by crankshaft 18 is connected through an interface component 105 and provides position data on line 110 connected to component 107 and provides pulses indicative of crankshaft rotation on a line 112 leading to component 66. For example, a pulse for each degree of revolution may be provided.

Control logic 59 supplies a command to an input register 114 for reading of the feed length data which is supplied to a count transfer control 116 which receives one input from control logic 59 and another input from clock and timing logic 118.

The encoder 40 driven in synchronism with feed roll 34 supplies pulses to a direction sensor and pulse multiplier 120 which is connected to clock and timing logic 118 and also to pulse steering component 85 which in conjunction with main binary register 124 and digital-to-analog converter 126 has been referred to in respect of FIG. 3 as a summer 84. This component 85 also receives an output from count transfer control 116 which, as will be seen, is connected via 122 from the clock and timing logic 118. Clock and timing logic 118 also is connected in controlling relation to component 85 and to a main binary register 124 which receives either upcount pulses or downcount pulses from component 85 depending on the direction of movement indicated by a signal from encoder 40.

The output from main register 124 passes through a digital-to-analog convertor 126 to a terminal of bypass switch 87 which, in one position, supplies the output to the square root circuit 86, and in another position, bypasses the said circuit 86.

The output from convertor 126 is also supplied to actuating component 89 which controls switch 87, and supplies a signal to component 66 which, as will be seen, is connected in controlling relation to panel meter 68, alarm signal 70 and control switch 26.

The speed encoder 38 driven by the feed roll motor supplies its output through the maximum speed and damping control 130 which, in turn, supplies one input to summer 82, the other input of which is derived from the circuit including the square root component 86. The speed error output of summer 82 is supplied through a servo-amplifier circuit consisting of the input amplifier and compensator 132, the pulse width control 134, and the power amplifier 136 to the feed roll drive motor T.

The power supply is indicated at 92 and component 136 provides for feedback on the current loop 138 and on the armature voltage loop 140 to control pulse width control 134. The pulse width control is also under the control of the current limiting option 142.

In FIG. 4, the movable roll 36 is shown above strip 16 of the stock, but operates in the same manner as the previous figures which show the movable roll beneath the stock. The servo-valve 50 interposed between pump 52 and actuator 48 is under the control of a servo-valve driver 146 which receives commands from control logic 59 and is, furthermore, under the control of a further selector switch 148 to open or close the feed rolls when in jog mode. Selector switch 148 also controls a drain valve 150 and a valve 152 which is connected in the line which will open the feed rolls when pressurized in the absence of pressure on the opposed side of the feed roll actuating piston.

To summarize the operation of the system as thus far described and particularly in reference to FIG. 4, as the crankshaft 18 turns the output of the crank position encoder 20 installed at the press limit switch location will become the same as the setting of the start thumbwheel manual input 102. At this point the input register 114 is instructed to read the contents of the feed length thumbwheel input 32 which feed length is transferred to the main binary register 124. Two things are accomplished in the transfer. First, the data is converted from binary coded decimal form which the press operator manually inserted at 32 to pure binary form acceptable to the digital-to-analog converter 126. Secondly, by counting the main binary register 124 up or down the direction of motion can be established. The output of the main binary register 124 is fed directly in parallel to the digital-to-analog converter 126 which provides an output voltage proportional to the programmed feed length and termed "position error".

Error level sensor 89 senses the position error signal and provides an output to the "in position" panel indicator 153. So long as the error exceeds a specified value the analog signal is passed by way of switch 87, which switch is under the control of error level sensor 89 through a square root circuit 86 the output of which is proportional to the amount of energy stored in the rotating part of the feed system at the operating speed. This square root circuit 86 functions to stop acceleration at the proper time and to control deceleration so that a smooth landing is accomplished at the final desired stop position. As soon as the position error signal falls below a prescribed value, the square root circuit 86 is switched out by switch 87 moving into the position illustrated and a linear relationship continues until the feed system is stopped. The speed of the feed drive at any time in the cycle is regulated by the damping circuit 130 using the tachometer generator 38 on the feed roll shaft as its input. Motor speed is limited to a set maximum value to avoid exceeding the allowable top frequency of the feed roll shaft encoder 40. The feed roll shaft encoder provides a certain number of pulses per revolution as an output to the pulse multiplier 120 which provides position and direction information.

As soon as the transfer of counts begins from the input register 114 by way of control logic 59 to the main register 124, the drive motor T will start moving. The encoder 40 on the feed roll shaft will begin to issue pulses which will be substracted from the count being accumulated in the main register 124. The timing logic and clock circuits 118 provide the steering by way of pulse steering circuit 85 and the appropriate timing so that pulses do not arrive at the counter at the wrong time. When the encoder 40 has provided as many pulses by way of the pulse multiplier 120 as were transferred from the input register 114, the system will again be "in position" and has fed the appropriate length of stock to the press.

The crankshaft encoder 20 has, during this time, also been turning and issuing pulses which, when the system has come into positon after a feed, are counted in the unused feed interval logic 66. When the output of the crankshaft encoder has accumulated counts to match the setting of the roll open thumbwheel input 100, the rolls release their clamping of the stock and whatever count has accumulated in the unused feed interval logic 66 is stored and displayed on the panel meter 68. This feature is particularly useful since this indication of remaining crank angle available during which feeding could be accomplished, indicates to the operator that he may speed up the press until this remaining unused cycle time has been completely utilized thereby improving the press output as a function of time. Interlock circuitry is also provided so that if the roll opens prior to the time when the material is in position the feed failure indicator 70 will light up and the press will stop.

When the crankshaft encoder output accumulates again to the setting of the roll closed thumbwheel input 99, clamping force is again applied to the feed roll and a short time thereafter drive motor T may be again energized.

While the foregoing summary applies to the system when in its run mode as determined by the setting of switch 108, other positions for this switch provides slightly different operation. In the measured jog position, the transfer between the input register 114 and the main register 124 is accomplished at a much slower rate and is enabled by depressing the jog button 104. The speed of transfer of this data is set with an oscillator whose frequency is determined by the setting of the jog speed switch 103. Feed roll motion occurs in measured jog mode only while the jog button 104 is depressed and it stops when one feed advance is completed. Rearming is accomplished by depressing button 106. In the jog mode setting of switch 108, input register 114 is blocked so that no limitation is placed on the length of feed. The speed is determined as in the measured jog mode of operation.

The availability of unused feed interval information from logic circuitry 66 allows the operator to operate the press at maximum speed for a given feed length.

The hydraulic arrangement for the system of FIG. 4 is illustrated in greater detail in FIG. 6. Comparing this hydraulic system for the moment with that illustrated in FIG. 1, it will be noted that both have fluid reservoirs 155 from which fluid is pumped by a motor and hydraulic pump arrangement 52 and supplied to a servo-valve 50 which, when properly enabled, supplies that fluid to the fluid actuator or piston 48 or 211 in FIGS. 6 and 7 to force the pinch roll 36 toward the feed roll 34 to engage the stock material. Similarly, each provides a drain 157 from the servo-valve 50 back to the reservoir 155. To open the rolls of FIG. 1, the direction of pressurized fluid from the motor pump arrangement is merely reversed and supplied to the opposite side of the piston in the fluid actuator 48, however, in FIGS. 4 and 6 it will be noted that the line 159 through which pressurized fluid may be supplied to open the roll is blocked at 161. To close the rolls in the FIG. 6 system, fluid is drawn from the reservoir 155 through suction filter 163 to the pump portion 165 of motor pump arrangement 52 where it is pressurized and pumped through one way check valve 167 and filter 169 to the input to the servo-valve 50 by way of line 171. When the servo-valve is in the proper position to pass this fluid under pressure on through line 173, the feed rolls close. When the servo-valve changes its position the fluid returns through line 173 and by way of the servo valve 50 to drain line 157, relieving pressure on the feed rolls which may free the stock sufficiently to permit stock motion during pilot action in the die. However, a spring loaded roll opening device as will be discussed in conjunction with FIG. 7, or a variation on the spring loaded device of FIG. 2, may be desired in some instances. To open the rolls wide apart, for example, during maintenance or threading of the initial stock material between the roll, a manually actuated valve 175 may be provided to supply the pressure fluid via line 177 and 181 directly to the other side of the fluid actuator 48 to open the rolls. A restriction 183, which provides a damping function on initial closing of the rolls when the spring loaded arrangement of FIG. 7 is used, is also illustrated. The remaining elements of FIG. 6 such as temperature gauge and level indicator 185, magnetic particle collector 187, vents such as 189, check valves such as 191, the air bleed valve 193, pressure gauge 195 and hydraulic accumulator 197 perform substantially their conventional function in this hydraulic circuit.

In FIG. 7, feed roll 34 and pinch roll 36 engage the strip stock 16 when pressurized fluid is supplied to conduit 173 and passes into the annular region 201 which is analogous to the annular region 203 of FIG. 6. Seals 205, 207 and 209 prevent fluid leakage. The presence of the pressurized fluid in the annular region 201 forces piston 211 and screw 213 downwardly, which by way of pinch roll yoke 215, shaft 216, and bearings 217, force the pinch roll 36 toward the feed roll 34. As with the feed roll opening annular area 219 of FIG. 6, an annular roll opening area 221 is provided in FIG. 7 for occasional use. A spring in the form of a cupped washer or Belleville washer 223 opens the roll slightly when the pressure in conduit 173 is removed.

Minimizing the distance which the feed rolls part when disengaging the stock material and/or the time required for that parting will allow still faster overall system operation and the system of FIG. 7 not only minimizes this release time, but further automatically accomodates to varying stock thickness. The assembly includes a cylindrical pin 225 surrounded by friction gripper 227 which is held in place relative to the piston 211 by a spacer 229 and snap ring 231 within the sleeve 233, which sleeve is affixed to the piston 211 by a second snap ring 235. Thus, cylindrical pin 225 may be frictionally slipped relative to the piston 211. The cylindrical pin 225 is held in place by a still further snap ring 237. When the feed rolls are closed, the Belleville washer 223 is in its flattened position, and when hydraulic pressure is removed from conduit 173, the washer 223 springs toward its rest position and conical configuration. This Belleville washer is added to produce a very small retraction motion of the pinch roll each time the pressure is released. Application of pressure on the upper side of the pinch roll piston and annular region 201 of course causes the piston to move downward, closing the rolls on the stock and flattening the washer 223. The friction gripper 227 may be a single annular member or may be several annularly disposed individual elements and is installed in the piston 211 so that it does not move relative to that piston along the axis. Application of pressure to the annular region 201 forces piston 211 downwardly against the force of the retraction spring or washer 223 until that spring force reaches a value high enough to slip the retraction pin 225 within the friction gripper.

When the pinch roll 36 is forced into contact with the strip stock material 16, a force will be stored in the retraction spring 223 equal to the frictional force exerted by the grippers on pin 225. When the pinch roll pressure in conduit 173 is released, the retraction spring 223 will lift the retraction pin 225 and with it the pinch roll piston 211 and pinch roll 36 until the spring force has fallen to a value equal to the frictional resistance to motion, for example, from the seals 209, 205 and 207. With the particular values of spring rate and gripper friction chosen in a preferred embodiment, this retraction motion of the pinch roll piston is around from 0.005 inches to 0.025 inches. This small motion produced by the retraction spring 223 is sufficient to take the pinch roll out of contact with the stock, thereby eliminating any frictional resistance to piloting of the stock by the press die. Proper selection of spring rate and gripper friction can provide a very small clearance between the pinch roll and stock so that the fluid displacement through the servo-valve 50 required to reapply the pinch roll against the stock may be held to a minimum for fast response. In the normal operation, little or no motion between cylindrical pin 225 and piston 211 occurs. However, when changing stock material, for example to a thinner material, the first closing of the pinch rolls will require a greater than normal travel accompanied by a greater than normal displacement of fluid and the restriction 183 prevents this initial gross displacement from damaging the system.

The preferred form of the invention is illustrated in FIGS. 4, 6 and 7. However, the earlier described features may be preferable in some situations and for some situations, a full servo controlled pinch roll lifting system utilizing a displacement feedback transducer for closed loop control of roll lift may be found to be desirable and such a system is illustrated in FIG. 5.

The variation of FIG. 5, like FIG. 1, employs a double acting pinch roll hydraulic cylinder 50 to close and separate rolls 34 and 36 about the stock material 16. Also, similarly to the previously discussed embodiments, a motor pump arrangement 52 supplies hydraulic fluid from a reservoir 155 to servo-valve 50, the actuation of which controls the closing and opening of the feed roll. A displacement feedback transducer 239 which may, for example, be a linear variable differential transformer is used to monitor the actual position of the pinch roll piston and to feedback a position or displacement signal on lines 241 and 243. A summing amplifier 245 receives this displacement signal along with commands for roll lifting and closing on line 247 and a stabilizing signal on line 249. The output of the summing amplifier 245 is supplied to a power amplifier 251 which in turn controls the servo-valve 50. A compensating network 253 which may, for example, be a resistance capacitance network to develop an approximate derivative of the displacement signal, provides the stabilizing signal on line 249 to the summing amplifier.

Thus, while the present invention has been described with respect to a specific preferred embodiment, numerous modifications will suggest themselves to those of ordinary skill in the art and accordingly the scope of the present invention is to be measured only by that of the appended claims.

We claim:

1. A stock feed device for feeding strip stock into a machine on each work cycle thereof, the machine having a shaft which makes one revolution during a work cycle, said device comprising:

a pair of feed rolls between which the stock is disposed, torque means for driving at least one said roll and operable in a first condition to supply a driving torque to the roll to drive the roll in stock feeding direction and operable in a second condition to supply a braking torque to the roll to brake the roll to a halt, means operable in a first predetermined rotated position of said shaft to make said rolls effective for driving said stock, control means following the operation of said first means to cause said torque means to go to said first condition thereof and operable to cause said torque means to go to said second condition when the minimum amount of feeding distance remains to bring said roll to a halt with the desired amount of stock fed into the machine, said control means including: means for developing a first feed signal representative of the amount of stock feed desired, a second signal representative of the rotated position of said one roll, and a third signal representative of the instantaneous angular velocity of said one roll, means for summing said first and second signals and for taking the square root of the sum to provide a fourth signal, and means responsive to said third and fourth signals for causing said torque means to go alternatively to said first condition or said second condition depending on the relative values of said third and fourth signals, and means operable in a second rotated position of said shaft for causing said rolls to release the stock therefrom.

2. A stock feed device for feeding strip stock into a machine on each work cycle thereof, the machine having a shaft which makes one revolution during a work cycle, said device comprising:

a pair of feed rolls between which the stock is disposed, torque means for driving at least one of said rolls and operable in a first condition to supply a driving torque to the roll to drive the roll in stock feeding direction and operable in a second direction to supply a braking torque to the roll to brake the roll to a halt, means operable in a first predetermined rotated position of said shaft to make said rolls effective for driving said stock, control means operable following the operation of said first means to cause said torque means to go to said first condition thereof and operable to cause said torque means to go to said second condition when the minimum amount of feeding distance remains to bring said roll to a halt with the desired amount of stock fed into the machine, said control means comprising: means for developing a first feed signal representative of the amount of stock feed desired and a second signal representative of the rotated position of said one roll and a third signal representative of the instantaneous angular velocity of said one roll, means for summing said first and second signals and for taking the square root of the sum to arrive at a fourth signal, means for summing a first further signal bearing a first predetermined proportion to said fourth signal and a second further signal bearing a second predetermined proportion to said third signal to arrive at a fifth signal, means responsive to said fifth signal for causing said torque means to go to said first condition when said fifth signal is on one side of zero and to said second condition when said fifth signal passes through zero to the other side of zero, and means operable in a second rotated position of said shaft for causing said rolls to release the stock therefrom.

3. A stock feed device according to claim 2 in which the said device and the torque means has total inertia J and said first proportion divided by said second proportion is substantially equal to the square root of twice the said braking torque divided by J.

4. A stock feed device for feeding strip stock into a machine on each work cycle thereof, the machine having a shaft which makes one revolution during a work cycle, said device comprising:

a pair of feed rolls between which the stock is disposed, torque means for driving at least one said roll and operable in a first condition to supply a driving torque to the roll to drive the roll in stock feeding direction and operable in a second direction to supply a braking torque to the roll to brake the roll to a halt, means operable in a first predetermined rotated position of said shaft to make said rolls effective for driving said stock, control means operable following the operation of said first means to cause said torque means to go to said first condition thereof and operable to cause said torque means to go to said second condition when the minimum amount of feeding distance remains to bring said roll to a halt with the desired amount of stock fed into the machine, said control means comprising: means for developing a first feed signal representative of the amount of stock feed desired and a second signal representative of the rotated position of said one roll and a third signal representative of the instantaneous angular velocity of said one roll, means for summing said first and second signals and for taking the square root of the sum to arrive at a fourth signal, means operable in a second rotated position of said shaft for causing said rolls to release the stock therefrom, and means responsive to a predetermined error value of said one roll for bypassing said means for taking the square root of the sum of said first and second signals.

5. A stock feed device for feeding strip stock into a machine on each work cycle thereof, the machine having a shaft which makes one revolution during a work cycle, said device comprising:

a pair of feed rolls between which the stock is disposed, torque means for driving at least one roll and operable in a first condition to supply a driving torque to the roll to drive the roll in stock feeding direction and operable in a second condition to supply a braking torque to the roll to brake the roll to a halt, means operable in first predetermined rotated position of said shaft to make said rolls effective for driving said stock, control means operble following the operation of said first means to cause said torque means to go to said first condition thereof and operable to cause said torque means to go to said second condition when the minimum amount of feeding distance remains to bring said roll to a halt with the desired amount of stock fed into the machine, means operable in a second rotated position of said shaft for causing said rolls to release the stock therefrom, and means for indicating the interval between the halting of said one roll and the opening of said rolls.

6. A stock feed device for feeding strip stock into a machine on each work cycle thereof, the machine having a shaft which makes one revolution during a work cycle, said device comprising:

a pair of feed rolls between which the stock is disposed, torque means for driving at least one roll and operable in a first condition to supply a driving torque to the roll to drive the roll in stock feeding direction and operable in a second condition to supply a braking torque to the roll to brake the roll to a halt, means operable in a first predetermined rotated position of said shaft to make said rolls effective for driving said stock, control means operable following the operation of said first means to cause said torque means to go to said first condition thereof and operable to cause said torque means to go to said second condition when the minimum amount of feeding distance remains to bring said roll to a halt with the desired amount of stock fed into the machine, means operable in a second rotated position of said shaft for causing said rolls to release the stock therefrom, and alarm means operable in response to the diminution to a predetermined minimum amount of the interval between the halting of said one roll and the opening of said rolls.

7. The method of operating a roll feed device for strip stock to feed a predetermined amount of stock into a machine on each machine work cycle in which the machine has a shaft that makes a single revolution during a work cycle and the feed device includes torque means to supply a torque to at least one roll to drive the roll in feed direction and to supply a braking torque to said roll to slow down and halt the roll, said method comprising:

supplying feed torque to said one roll to advance stock into the machine, interrupting the supply of feed torque to said one roll while initiating the supply of braking torque thereto when the feeding distance remaining to be traversed has reached the minimum value that will permit the available braking torque to halt the feed roll at the desired position without reversal, opening the rolls to release the stock after said one roll comes to a halt and in a program controlled rotated position of said machine shaft, and providing a response which is a function of the interval between the halting of said one roll and the opening of said rolls.

8. The method according to claim 7 which includes closing the rolls on the stock prior to the supply of feed torque to said one thereof and in a program controlled rotated position of said machine shaft.

9. The method according to claim 7 wherein said response includes indicating the interval between the halting of said one roll and the opening of said rolls.

10. The method according to claim 7 wherein said response includes activating an alarm when the interval between the halting of said one roll and the opening of said rolls approaches zero.

11. The method according to claim 7 wherein said response includes halting the machine when the interval between the halting of said one roll and the opening of said rolls reaches zero.

12. The method of operating a roll feed device for strip stock to feed a predetermined amount of stock into a machine on each machine work cycle in which the machine has a shaft that makes a single revolution during a work cycle and the feed device includes a torque means to supply a torque to at least one roll to drive the roll in feed direction and to supply a braking torque to said roll to slow down and halt the roll, said method comprising:

developing a first feed signal in conformity with the feed desired, developing a second signal in conformity with the rotated position of said one roll, developing a third signal in conformity with the instantaneous angular velocity of the roll, summing said first and second signals and extracting the square root thereof to obtain a fourth signal which diminishes as the second signal increases, summing the third and fourth signals to obtain a fifth signal which passes through zero when said fourth signal diminishes to a predetermined amount, causing said torque means to develop feed torque when said fifth signal is on one side of zero and supplying said feed torque to said one roll to advance stock into the machine, and causing said torque means to interrupt the supply of feed torque to said one roll and instead to apply braking torque thereto when the fifth signal passes through zero to the other side thereof and the feeding distance remaining to be traversed has reached the minimum value that will permit the available braking torque to stop the feed roll at the desired position without reversal.

13. The method according to claim 12 in which said third and fourth signals are multiplied by respective constants K3 and K4 prior to the summing thereof.

14. The method according to claim 13 in which the ratio of K4 to K3 is substantially equal to the square root of the amount which is obtained by dividing twice the said braking torque by the inertia of said feed device.

15. In a feed roll unit for intermittently feeding strip material to a cycleable stamping press, an improved feed control comprising:

first programmable means for establishing the start of material feed at a selectable time in the press cycle, second programmable means for establishing a selectable time in the press cycle for feed roll separation, program controlled means for establishing a predetermined time for feed roll closing, program controlled means for establishing the length of material to be fed during each stamping press cycle, and means for providing an indication of the remaining time between the completion of material feeding and the time of roll lift.

16. For use with a cyclically operable stamping press, a feed system including a pair of feed rolls for supplying strip stock material to the press during a selected interval of each press cycle, the feed rolls being operable between a stock engaging position and a position disengaged from the stock, the system including:

first means continuously urging the feed roll toward one of said roll positions, second means selectively operable during an operator determinable portion of the press cycle to override said first means to force the feed rolls to the other of said roll positions, and adjustment means for causing said rolls to automatically adjust to a change in stock thickness, said adjustment means comprising means including friction gripper means frictionally coupling one of said rolls to one of said first or second means to permit said one roll and said one of said first or second means to slip relative to each other when the force therebetween exceeds a prescribed amount determined by said gripper means.

17. The system of claim 16 wherein the first means comprises a spring and the override means comprises a magnetic actuator.

18. The system of claim 16 wherein the first means comprises a spring and the override means comprises a hydraulic actuator.

19. The apparatus of claim 4 wherein said machine is a cyclically operating crank driven stamping press and including means for interrupting press operation in the event that the desired amount of stock is not supplied to the press during a selected interval of the press cycle.

20. The apparatus of claim 4 wherein said machine is a cycleable stamping press and including means for intermittently feeding strip stock material to said press comprising:

means for operating said stock feed device intermittently with a manual push button control to advance the stock a maximum of one feed length without rearming said feed device.

* * * * *